US008459486B2

(12) United States Patent
Luburic et al.

(10) Patent No.: US 8,459,486 B2
(45) Date of Patent: Jun. 11, 2013

(54) CONTAINER AND LID

(75) Inventors: Frano Luburic, Anaheim Hills, CA (US); Terrance Iker, Arlington Heights, IL (US); Josef Bingisser, Costa Mesa, CA (US); Kirk Samlalsingh, Mansfield, TX (US); Dennis Willis, Lake Forest, CA (US)

(73) Assignee: Ropak Corporation, FountainValley, CA (US)

( * ) Notice: Subject to any disclaimer, the term of this patent is extended or adjusted under 35 U.S.C. 154(b) by 0 days.

(21) Appl. No.: 12/762,742

(22) Filed: Apr. 19, 2010

(65) Prior Publication Data

US 2011/0253717 A1 Oct. 20, 2011

(51) Int. Cl.
*B65D 17/40* (2006.01)
*B65D 41/16* (2006.01)
*B65D 41/32* (2006.01)

(52) U.S. Cl.
USPC ..... 220/276; 220/780

(58) Field of Classification Search
USPC ..... 220/266, 780, 789, 790, 792, 794, 220/276; 215/253, 254, 344
See application file for complete search history.

(56) References Cited

U.S. PATENT DOCUMENTS 3,358,875 A 12/1967 Ekstrom
3,556,338 A 1/1971 Wilkinson
3,696,962 A 10/1972 Fehres et al.
3,753,511 A 8/1973 Ruch
3,840,152 A 10/1974 Hodge
4,209,107 A 6/1980 Crisci
4,228,916 A 10/1980 Weingardt
4,252,248 A 2/1981 Obrist et al.
4,256,240 A 3/1981 Woinarski
4,293,080 A 10/1981 Letica
4,349,119 A 9/1982 Letica
4,412,630 A 11/1983 Daenen
4,418,833 A 12/1983 Landis
4,444,332 A 4/1984 Wilden et al.
4,471,880 A 9/1984 Taylor et al.
4,538,741 A 9/1985 Jacobs
4,735,337 A 4/1988 Von Holdt
4,768,668 A 9/1988 Van Den Brink
4,934,554 A 6/1990 Edwards et al.
5,065,887 A 11/1991 Schuh et al.
5,103,993 A 4/1992 Bingisser
5,186,318 A 2/1993 Oestreich et al.
5,310,075 A 5/1994 Wyler
5,356,026 A 10/1994 Andress et al.
5,456,375 A 10/1995 May
5,549,213 A 8/1996 Robbins et al.
5,617,968 A 4/1997 Luburic
5,626,251 A 5/1997 Luburic et al.
5,730,309 A 3/1998 Jiradejnunt et al.
5,806,710 A 9/1998 Shiffer et al.
5,850,935 A 12/1998 Luburic et al.

(Continued)

OTHER PUBLICATIONS

Photographs of a container lid publicly available prior to Apr. 2010.

*Primary Examiner* — Harry Grosso
(74) *Attorney, Agent, or Firm* — Vedder Price PC

(57) ABSTRACT

A lid for a container includes a central portion; a channel at a periphery of the central portion configured to form a substantially liquid-tight gasketless seal with the container, the channel including an inner skirt for contacting an inner surface of the container and an outer skirt; and a protrusion protruding from the inner skirt and being configured to form an interference fit with the inner surface of the container.

35 Claims, 10 Drawing Sheets

U.S. PATENT DOCUMENTS

| | | | |
|---|---|---|---|
| 5,908,133 | A | 6/1999 | Luburic et al. |
| 5,913,446 | A | 6/1999 | Von Holdt |
| 5,934,500 | A | 8/1999 | Cogger et al. |
| 6,098,833 | A | 8/2000 | Von Holdt |
| 6,164,484 | A | 12/2000 | Fiore et al. |
| 6,168,044 | B1 | 1/2001 | Zettle et al. |
| 6,257,440 | B1 | 7/2001 | Perkins et al. |
| 6,279,774 | B1 | 8/2001 | Chute et al. |
| 6,604,647 | B1 | 8/2003 | Luburic |
| 6,619,498 | B2 | 9/2003 | Von Holdt, Jr. |
| 6,644,492 | B1 | 11/2003 | Mitchell |
| 7,134,567 | B2 | 11/2006 | Luburic |
| 7,207,457 | B2 | 4/2007 | Schwarz et al. |
| 2002/0148846 | A1 | 10/2002 | Luburic |
| 2002/0148847 | A1 | 10/2002 | Luburic |
| 2004/0060942 | A1 | 4/2004 | Luburic |
| 2004/0084465 | A1 | 5/2004 | Luburic |
| 2006/0076260 | A1 | 4/2006 | Luburic |
| 2007/0084870 | A1 | 4/2007 | Luburic |
| 2007/0205196 | A1 | 9/2007 | Burney et al. |
| 2008/0083768 | A1 | 4/2008 | Luburic |
| 2008/0149639 | A1 | 6/2008 | Luburic |
| 2008/0230550 | A1 | 9/2008 | Burney et al. |
| 2008/0257886 | A1 | 10/2008 | Luburic |
| 2009/0152280 | A1 | 6/2009 | Luburic |

CONTAINER AND LID

BACKGROUND

1. Field of the Invention

The present invention relates to containers and lids.

2. Discussion of the Related Art

Conventionally, liquids are commonly packed into plastic containers with snap-on or screw-on lids or containers sealed with a film.

In a related art snap-on container, a rubber tube is used to prevent liquid from leaking through a container-lid interface. This rubber tube serves as a gasket that fills voids that exist in the container-lid interface.

While this method is effective, it adds cost both in the extra material required for manufacturing the rubber tube and in the operation required to apply the gasket to the lid.

In addition, care must be employed to ensure gasket-liquid compatibility.

Also, recycling is difficult because the gasket material is often a different composition from the lid material and because removal of the gasket can be difficult.

SUMMARY

The present invention is directed to improved containers and lids.

An advantage of the present invention is to provide a container and lid that minimizes or prevents liquid from leaking.

Another advantage of the present invention is to provide a container and lid that reduces the cost of manufacturing.

Another advantage of the present invention is to provide a container and lid that are easily recycled.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a lid for a container includes: a central portion for covering an opening of the container; a channel at a periphery of the central portion configured to form a substantially liquid-tight gasketless seal with the container, the channel including an inner skirt for contacting an inner surface of the container and an outer skirt for extending around an outside surface of the container; and a protrusion protruding from the inner skirt and being configured to form an interference fit with the inner surface of the container.

In another aspect, a lid for a container includes: a central portion; an outer skirt at a periphery of the central portion; and a protruding ridge on an inner surface of the outer skirt, wherein the protruding ridge includes a plurality of ribs.

In yet another aspect, a container comprises: a base; a sidewall extending upwardly from the base to an upper rim, wherein the sidewall surrounds an inner cavity, and wherein the sidewall tapers away from the inner cavity while extending upwardly from the base; a satellite ring extending outwardly from the container sidewall; and a bead protruding outwardly from the container sidewall. A lid comprises: a central body portion; a channel around a periphery of the central body portion configured to form a substantially liquid-tight gasketless seal with the upper rim of the container, the channel including an outer skirt and an inner skirt, wherein the inner skirt is configured to contact an inner surface of the container sidewall, the inner skirt including an inner skirt protrusion protruding outwardly from the inner skirt and extending around the central body portion, wherein the inner skirt protrusion is configured to form an interference fit with the inner surface of the sidewall; a tearline for separating an upper portion the outer skirt and a lower tearstrip portion, wherein a lower edge of the lower tearstrip portion is configured to lie adjacent the satellite ring of the container; and a first protruding ridge on the upper portion of the outer skirt and a second protruding ridge on the lower tearstrip portion, wherein the first and second protruding ridges are configured to lie below the container bead.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
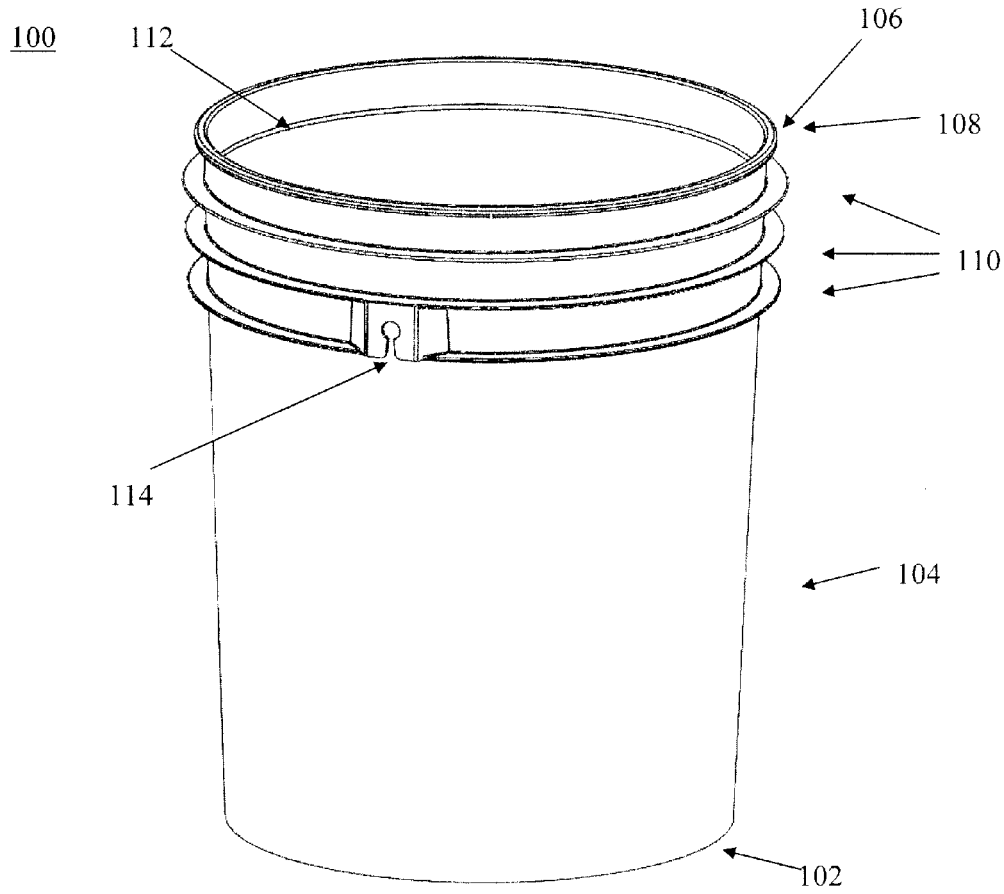
FIG. 1 illustrates a side perspective view of a container according to a first embodiment of the present invention.
Figure 2A:
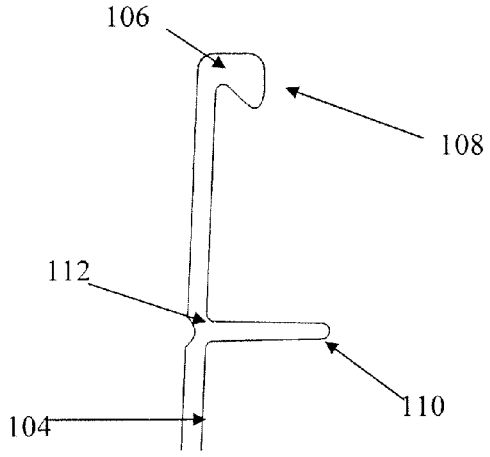
FIG. 2A illustrates a partial cross-sectional view of an upper portion of the container of FIG. 1.
Figure 2B:
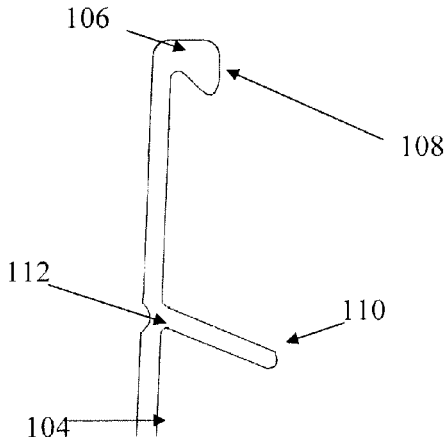
FIG. 2B illustrates a partial cross-sectional view of an upper portion of a container according to another embodiment.

FIG. 1 illustrates a side perspective view of a container according to a first embodiment of the present invention. FIG. 2A illustrates a partial cross-sectional view of an upper portion of the container of FIG. 1. FIG. 2B illustrates a partial cross-sectional view of an upper portion of a container according to another embodiment.

As illustrated, the container 100 includes base 102, sidewall 104, upper rim 106, bead 108, one or more flanges 110, indent 112 and bail ear 114. Although not illustrated, base 102 encloses the bottom of the container 100 and sidewall 104 extends upwardly from the base 102 to form an inner cavity of the container 100. The top of the sidewall 104 forms an upper rim 106 defining an opening to the inner cavity of the container.

Sidewall 104 is illustrated as a having a circular cross-section. One of ordinary skill in the art will appreciate that the sidewall 104 may have various cross-sections or contours. For example, the sidewall 104 may include one or more corners, or the sidewall 104 may have a circular cross-section near the top of the sidewall and a different cross-section near the bottom of the sidewall.

Bead 108 is illustrated protruding outwardly from the top of the sidewall 104. One of ordinary skill in the art will appreciate the bead 108 may have various positions or profiles. For example, the bead 108 may be spaced from the top of the sidewall 104.

In another possible configuration, the bead 108 may be a portion of the sidewall 104 above a recess in an outer surface of the sidewall. As illustrated, bead 108 protrudes from the sidewall. When a lid is placed on the container 100, a portion of the lid may be positioned in the recess under the bead 108 such that the lid is held to the container 100.

Flange 110 protrudes outwardly from the sidewall 104 of the container 100. As illustrated, the flange 110 extends generally horizontally outward from the container. One of ordinary skill in the art will appreciate the flange 110 may have various configurations. For example, the flange 110 may extend upwardly or downwardly while extending outwardly. The flange 110 may extend entirely or partially around the container 100.

The presence of flange 110 may improve a tamper-evidencing function by being in close proximity to a lower edge of a lid skirt. In this case, the flange 110 makes it more difficult for persons to remove the lid from the container without leaving some "tamper-indication" such as a tear along the lid skirt or other damage or deformation to the container or lid. Positioning of the flange 110 relative to the lid skirt may preclude finger(s) or other objects access under the lid skirt, where they may lift, pry, or dislodge the lid from the container.

At a junction of the sidewall 104 and flange 110, indent 112 may be formed in sidewall 104 opposite of the flange 110. Thus, a reduced amount of plastic may be used to form the junction during an injection molding process. This reduces the time needed for cooling of the plastic throughout the junction, thereby promoting consistent strength throughout the container. In one aspect, the indent 112 may allow the junction to have a substantially constant thickness through the junction. Although not illustrated, an indent 112 may be formed corresponding to each flange 110.

As illustrated, bail ear 114 may be formed between flanges 110. Although not illustrated, another bail ear 114 may be formed on an opposite side of the container 100, allowing for attachment of a handle to both bail ears 114. Furthermore, the bail ear 114 may be formed at other locations on the container.

The entire container may be integrally formed together as a unitary single unit, by a process such as injection molding. Also, the container 100 may be formed of plastic. In other embodiments, the container may be formed of other materials, such as metal or glass.

Figure 3:
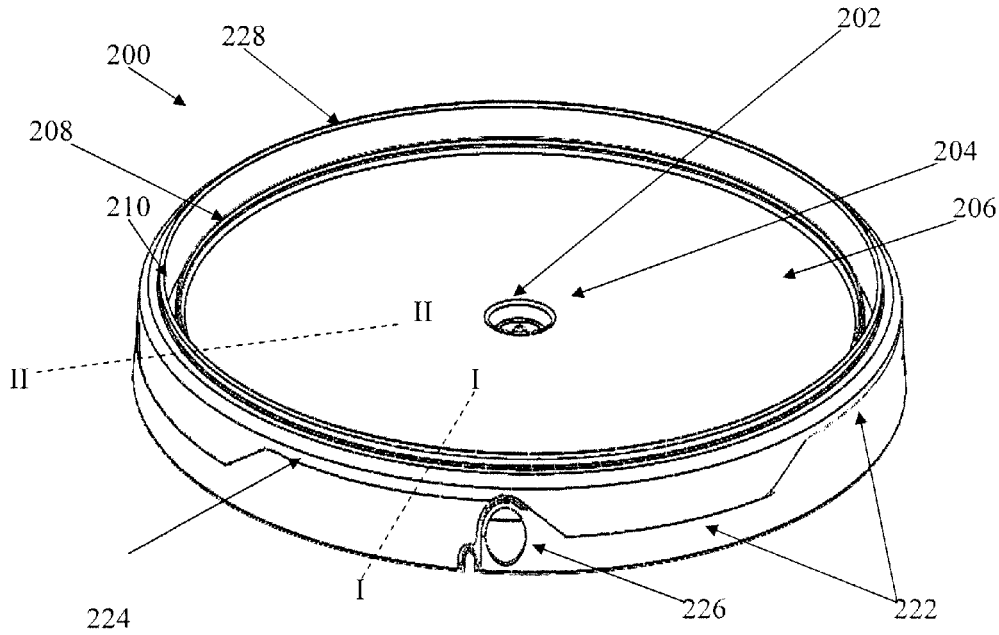
FIG. 3 illustrates a top perspective view of a lid according to a first embodiment of the present invention.
Figure 4:
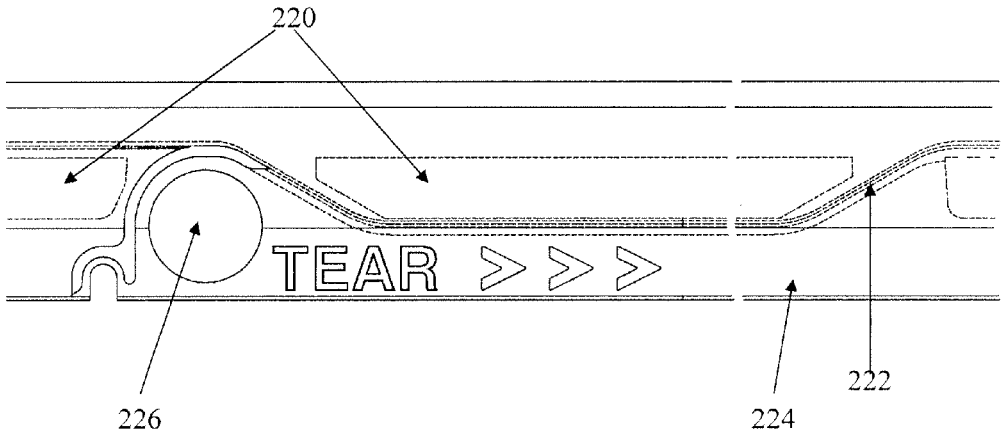
FIG. 4 illustrates a side view of an outer skirt of the lid of FIG. 3 according to a first example of the first embodiment.
Figure 5:
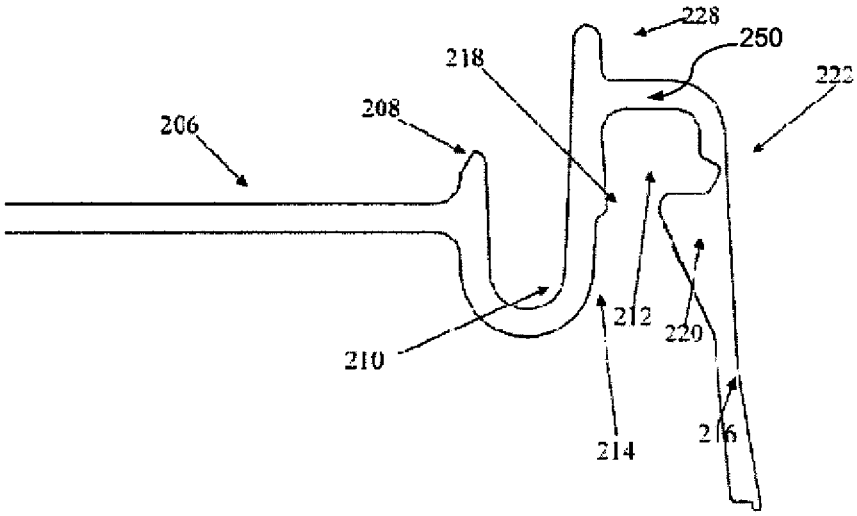
FIG. 5 illustrates a cross-sectional view of the lid of FIG. 4 along line I-I.
Figure 6:
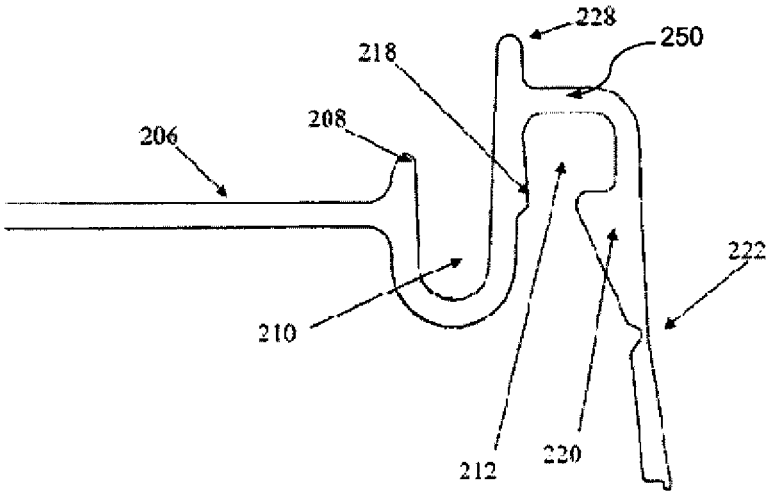
FIG. 6 illustrates a cross-sectional view of the lid of FIG. 4 along line II-II.
Figure 7:
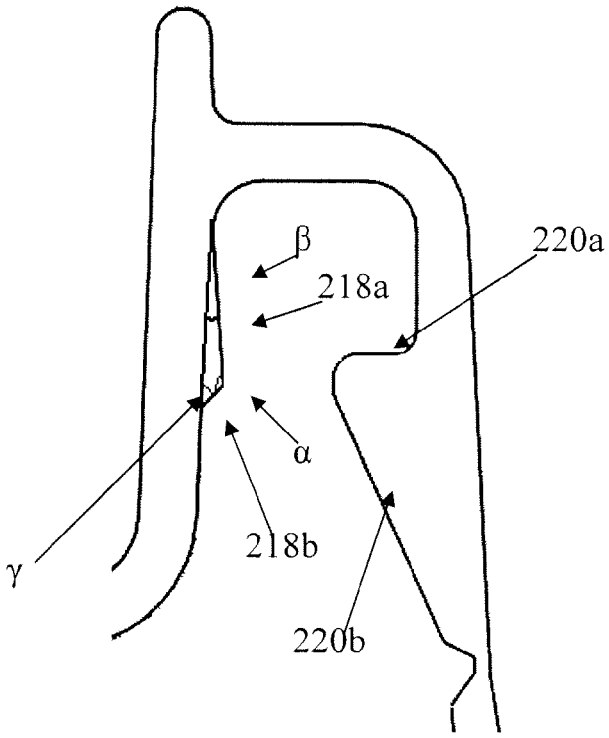
FIG. 7 illustrates a partial cross-sectional view of the lid of FIG. 4 along line II-II.
Figure 8:
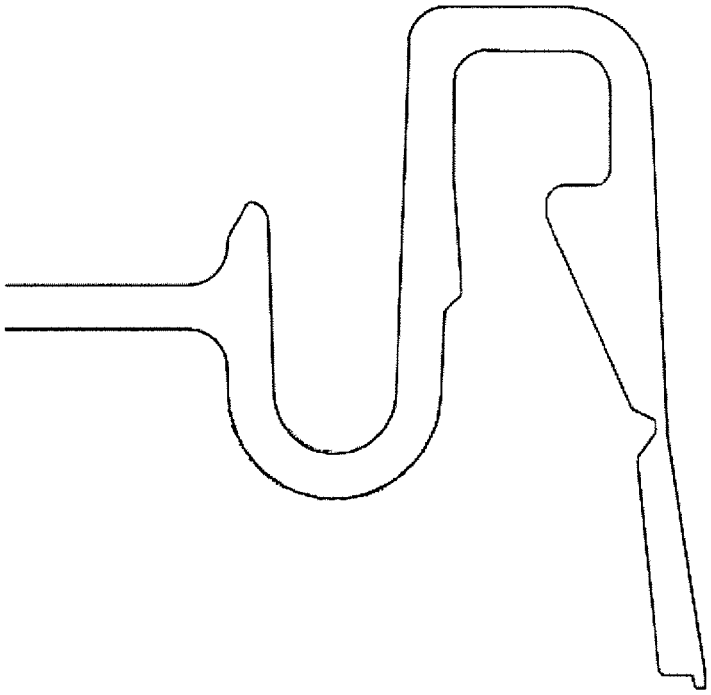
FIG. 8 illustrates a partial cross-sectional view of a lid according to another embodiment of the present invention.
Figure 9:
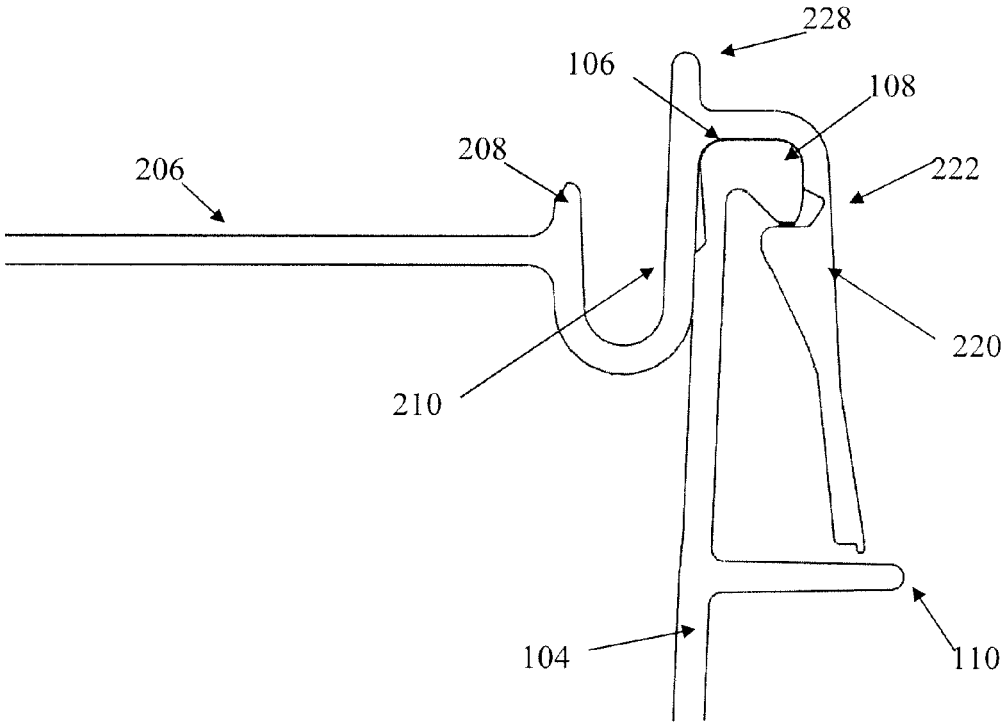
FIG. 9 illustrates a cross-sectional view of the container with the lid of FIG. 4 along line I-I.
Figure 10:
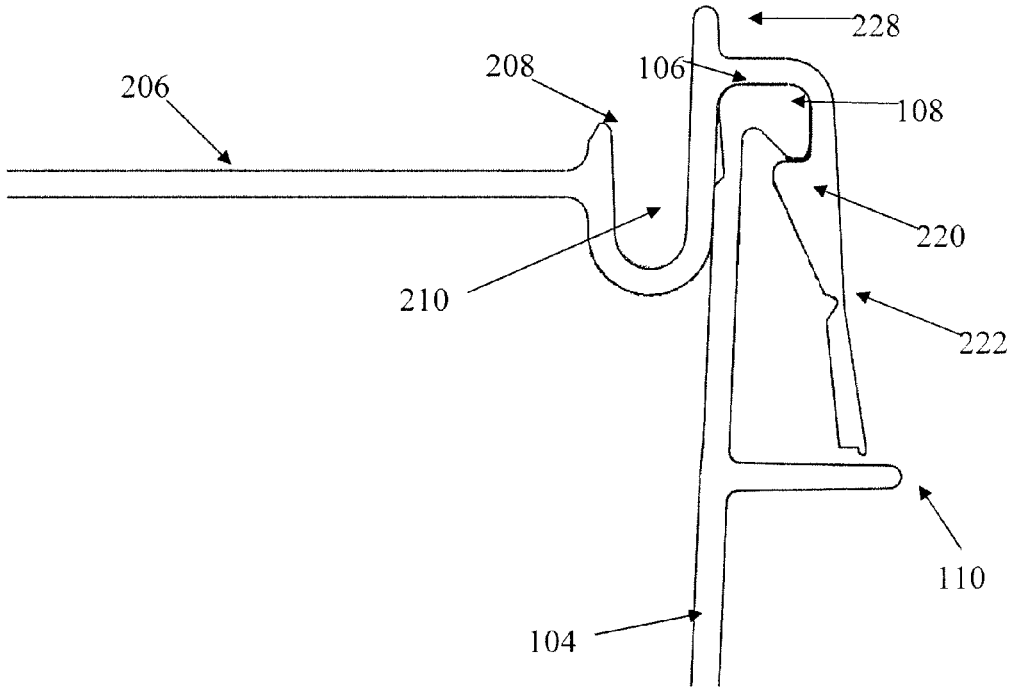
FIG. 10 illustrates a cross-sectional view of the container with the lid of FIG. 4 along line II-II.

FIG. 3 illustrates a top perspective view of a lid according to a first embodiment of the present invention. FIG. 4 illustrates a side view of an outer skirt of the lid of FIG. 3 according to a first example of the first embodiment. FIG. 5 illustrates a cross-sectional view of the lid of FIG. 4 along line I-I. FIG. 6 illustrates a cross-sectional view of the lid of FIG. 4 along line II-II. FIG. 7 illustrates a partial cross-sectional view of the lid of FIG. 4 along line II-II. FIG. 8 illustrates a partial cross-sectional view of a lid according to another embodiment of the present invention. FIG. 9 illustrates a cross-sectional view of the container with the lid of FIG. 4 along line I-I. FIG. 10 illustrates a cross-sectional view of the container with the lid of FIG. 4 along line II-II.

As illustrated in FIGS. 3-10, the lid 200 may be sized to cover an opening of a corresponding container 100. As illustrated, lid 200 has a circular shape but may include one or more corners depending on the shape of the opening of container 100. As illustrated, the lid may include a gate 202 positioned at a top side of the center of the lid 200. In other configurations, gate 202 may be positioned away from the center of the lid 200 or may be formed at a bottom side of the lid 200.

Gate well 204 is illustrated surrounding the gate 202 and raised portion 206 is illustrated surrounding the gate well 204. In one aspect, the raised portion 206 extends above the highest portion of the gate 202. As such, the gate 202 may be protected from receiving a load from objects, such as a container 100, being placed on the lid 200.

As illustrated, stacking guide 208 may be positioned at a periphery of the raised portion 206. However, the positioning of stacking guide 208 may be determined based on the size of the base 102 of the corresponding container 100. When a base 102 of a container 100 may be placed on a lid 200, a stacking guide aids in guiding the base 102 to the center of the lid 200 and aids in maintaining the base 102 on the lid 200. In the illustrated embodiment, the stacking guide protrudes upwardly from the periphery of the raised portion 206 and includes a downwardly slanted surface facing the center of the lid 200 that further aids in guiding the base 102 of the container 100 to the appropriate position on the lid 200. As illustrated, the stacking guide 208 forms a substantially continuous circle around the center of the lid 200. In embodiments, the stacking guide 208 may include a plurality of stacking features separated from each or otherwise discontinuous.

As illustrated, a first channel 210 may be positioned at a periphery of the stacking guide 208. In another embodiment, first channel 210 may be positioned further towards to the center of lid 200, or the lid may include more first channels 210. One or more of the first channels 210 may be disposed at a periphery of the stacking guide 208 or towards the center of the lid 200.

As illustrated, first channel 210 surrounds a center portion of lid 200. In other aspects, first channel 210 may extend partially around the center portion of the lid 200. In one aspect, first channel 210 may function as a spring by absorbing loads placed on the lid 200 in a generally horizontal direction and allowing the lid 200 to flex inwardly or outwardly when being placed on a container.

As illustrated, first channel 210 includes first and second generally vertical walls and a third wall connecting lower portions of the first and second walls. The third wall may form the bottom at the first channel 210.

As illustrated, stacking guide 208 may be formed as an extension of a first wall of the first channel 210. In another embodiment, the stacking guide 208 may be separate from the first channel 210.

A second channel 212 may be shaped to form a substantially liquid-tight gasketless seal with the container. As illustrated, the second channel 212 may include an inner skirt 214, an outer skirt 216 and a wall 250 connecting upper portions of the inner skirt 214 and outer skirt 216. As illustrated, the second channel 212 surrounds a center portion of lid 200. When the lid 200 is placed on a container 100, the inner skirt 214 lies adjacent and may contact an inner surface of the sidewall 104 and the outer skirt 216 may extend around an outer surface of the sidewall 104.

As illustrated, the inner skirt 214 of the second channel 212 may be also one of the generally vertical walls of the first channel 210. In another embodiment, the first channel 210 and second channel 212 may share no common walls.

The inner skirt 214 may include an inner skirt protrusion 218. When the lid 200 is placed on the container 100, the inner skirt protrusion 218 forms an interference fit with the inner surface of the sidewall 104 of the container 100. Because the inner skirt protrusion 218 interferes with the inner surface of the sidewall 104, a contact force may be applied between the inner skirt protrusion 218 and the inner surface of the sidewall 104. This contact force minimizes or prevents liquid from leaking when the container 100 is on its side or upside down.

The inner skirt protrusion 218 may extend around the entire lid or a portion thereof. Also, the inner skirt protrusion 218 may extend around the entire lid to form a complete loop such that a starting and ending point of the loop are the same or to form an incomplete loop such that a starting and ending point of the loop are different. In one embodiment of the incomplete loop, the inner skirt protrusion 218 may have a generally helical shape.

In the illustrated example, the inner skirt protrusion 218 may be an angled protrusion. As illustrated in FIG. 7, the inner skirt protrusion 218 includes a first surface 218*a* extending upwardly and towards the center of lid 200 and a second surface 218*b* below the first surface 218*a* that extends downwardly and towards the center of lid 200. In one aspect, the first and second surfaces may have an angle a with respect to one another of between 60 degrees and 170 degrees. In another aspect the first and second surfaces may have an angle $\alpha$ with respect to one another of between 90 degrees and 160 degrees. In another aspect the first and second surfaces may an angle $\alpha$ with respect to one another of between 120 degrees and 150 degrees.

In one aspect, the angle $\beta$ of the first surface 218*a* with respect to the inner surface of the inner skirt 214 may be less than the angle $\gamma$ of the second surface 218*b* with respect to the inner surface of the inner skirt 214. As such, the slope of the second surface 218*b* may be greater than the slope of the first surface 218*a*, which is believed to provide a better seal.

The outer skirt 216 may include at least one protruding ridge 220. As illustrated in FIG. 4, each protruding ridge 220 may be a unitary bulk protruding ridge.

As illustrated in FIG. 7, the protruding ridge 220 may include an upper surface 220*a* that extends generally horizontally outward or extends upward or downward while extending outward. When the lid 200 is placed on the container 100, the protruding ridge 220 may be positioned under the bead 108, thereby holding the lid 200 to the container 100. The protruding ridge 220 may also include a lower surface 220*b* that tapers towards the inner surface of the outer skirt. As such, as the lid 200 is being placed on the container 100, the lower surface 220*b* guides the container into a gap between the protruding ridge 220 and the inner skirt 214.

The protruding ridge 220 may be positioned substantially opposite of the inner skirt protrusion 218. As illustrated, the upper surface 220*a* of the protruding ridge 220 may be elevated slightly above an upper portion of the second surface 218*b* of the inner skirt protrusion 218. In another embodiment, the protruding ridge 220 may be positioned a little higher or a little lower. In one example, the upper surface 220*a* of the protruding ridge 220 may be positioned below an upper portion of the second surface 218*b* of the inner skirt protrusion 218, or below a lower portion of the second surface 218*b* of the inner skirt protrusion 218. In another example, the upper surface 220*a* of the protruding ridge 220 may be elevated above a midpoint of the first surface 218*a* of the inner skirt protrusion 218.

As illustrated in FIGS. 3 and 4, tearline 222 may be a thin portion of the outer skirt 216 that extends partially or fully around the lid, separating an upper portion of the outer skirt 216 from a lower tearstrip 224 portion of the outer skirt 216. In one embodiment, the tearline 222 includes an upper tearline that extends over a first protruding ridge 220 connected to a lower tearline that extends below a second protruding ridge 220. As such, when the tearstrip 224 is removed from the lid, the first protruding ridge 220 may be removed with the removal of the tearstrip 224, while the second protruding ridge 220 remains with the upper portion of the outer skirt 216.

Figure 12:
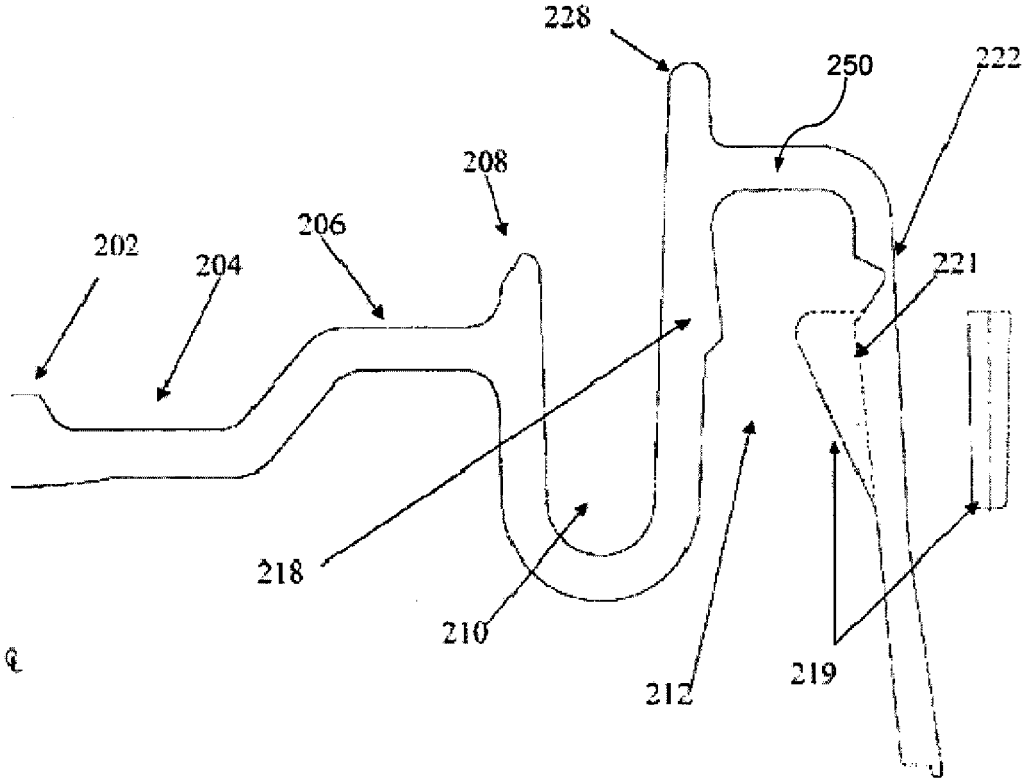
FIG. 12 illustrates a cross-sectional view of the lid of FIG. 11 along line I-I.
Figure 13:
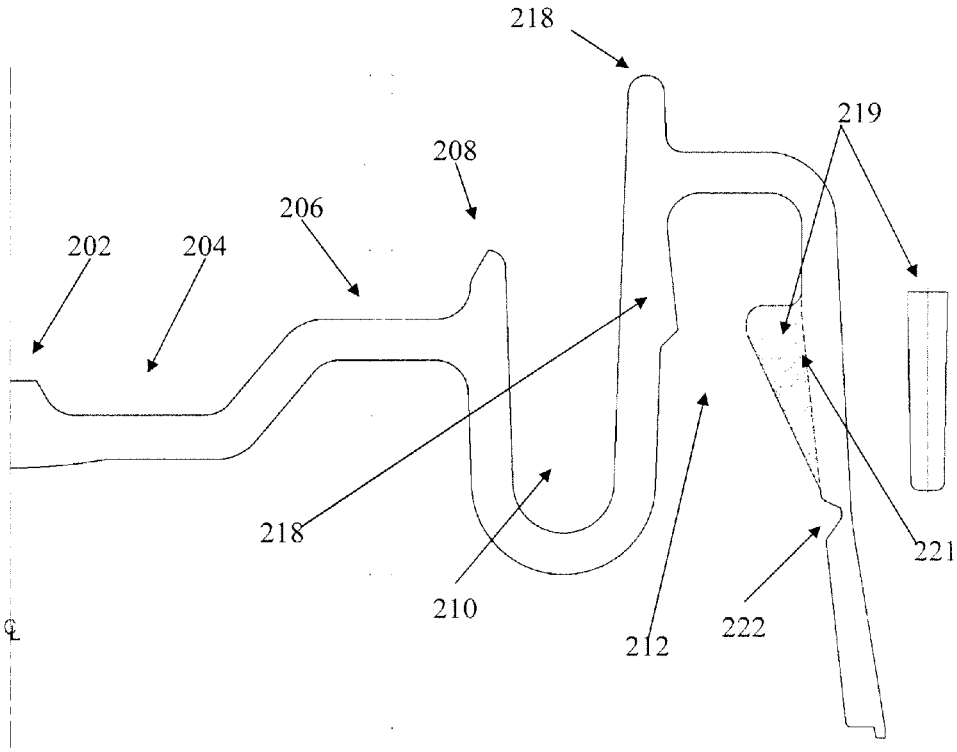
FIG. 13 illustrates a cross-sectional view of the lid of FIG. 11 along line II-II.

As illustrated in FIGS. 12 and 13, the tearstrip 224 may include a tearstrip opening 226. In another embodiment, the tearstrip 224 may include other pull structures, such as a pull tab.

The lid 200 may include step 228. Step 228 may protrude upwardly from an upper surface of the second channel 212 as illustrated in FIG. 5. When a container is stacked on the lid, shifting may occur and the container may jump over stacking ring 208. In this case, step 228 helps to maintain the container 100 on lid 200. In another embodiment shown in FIG. 8, the upper wall of the second channel, the inner skirt protrusion 218 and the outer skirt 216 may be raised up a distance the step 228 protrudes upwardly, thereby eliminating the step 228. However, the storage capacity of the container may be reduced if the center portion of the lid 200 is correspondingly lowered.

Figure 11:
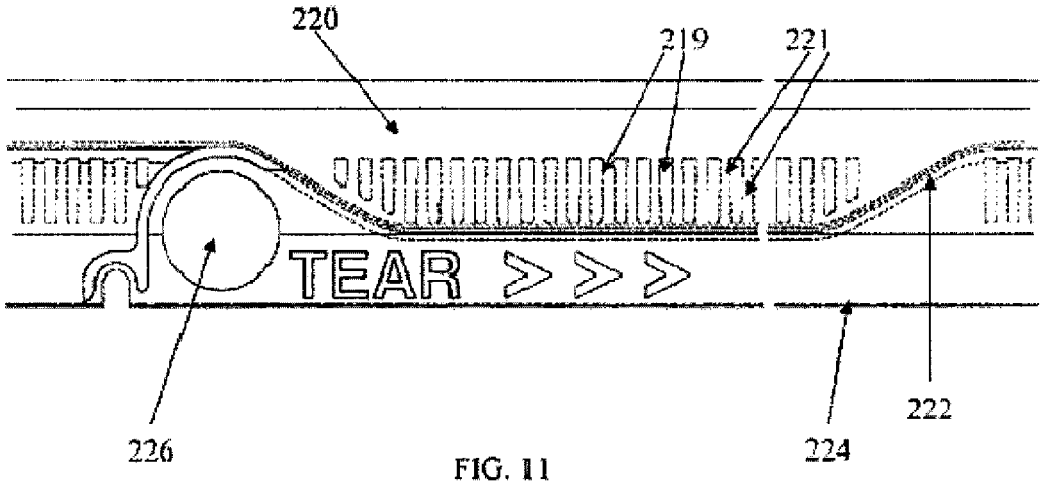
FIG. 11 illustrates a side view of an outer skirt of the lid of FIG. 3 according to a another example of the first embodiment.

FIG. 11 illustrates a side view of an outer skirt of the lid of FIG. 3 according to a second example of the first embodiment. FIG. 12 illustrates a cross-sectional view of the lid of FIG. 11 along line I-I. FIG. 13 illustrates a cross-sectional view of the lid of FIG. 11 along line II-II.

In another example of the first embodiment of the present invention, the protruding ridge 220 may include a plurality of protruding ribs. A cross-sectional view of one embodiment of a protruding rib is shown in a floating drawings to the right of the outer skirt 222.

By forming the protruding ridge 220 from a plurality of protruding ribs 219, the amount of material needed to form the protruding ridge 220 can be reduced. In one aspect, substantially parallel protruding ribs 219 are separated by spaces 221. The distance between adjacent protruding ribs 219 may be greater than a thickness of the ribs, such that the amount of material used to form the protruding ridge 220 may be reduced by 50% or more relative to a bulk protruding ridge of the same size.

Also, the protruding ridge 220 formed of a plurality of protruding ribs 219 may be more accommodating than a bulk protruding ridge. A such, the lid may be easier to remove from the mold during manufacturing and avoids deformation that occurs when removing the lid from the mold. Also, the lid may be easier to remove from a container. For a lid having a bulk protruding ridge, lid removal may be stiff. For a lid having a protruding ridge 220 formed of a plurality of protruding ribs 219, lid removal may be smoother.

Furthermore, a bulk protruding ridge cools slowly, causing degradation of the strength of the ridge. A protruding ridge 220 formed of a plurality of protruding ribs 219 cools faster, thereby avoiding such degradation.

Figure 14:
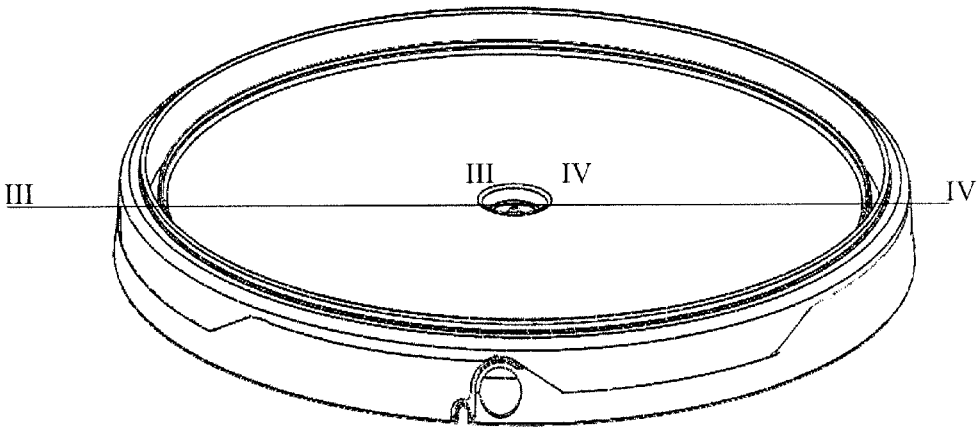
FIG. 14 illustrates a top perspective view of a lid according to another embodiment of the present invention.
Figure 15:
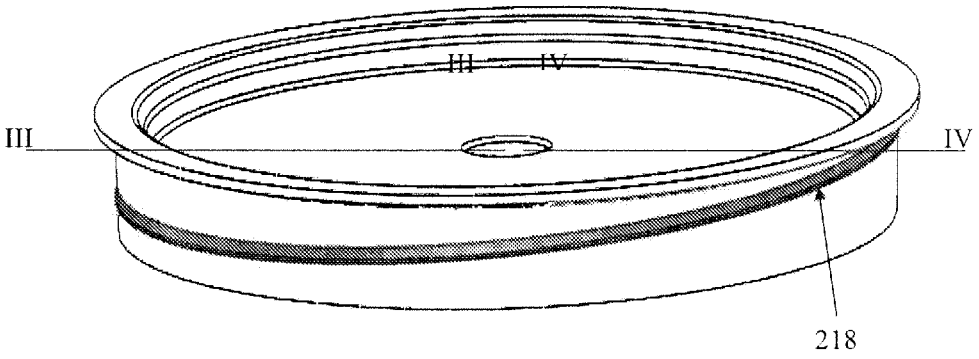
FIG. 15 illustrates a front side perspective view of a portion of the lid of FIG. 14.
Figure 16:
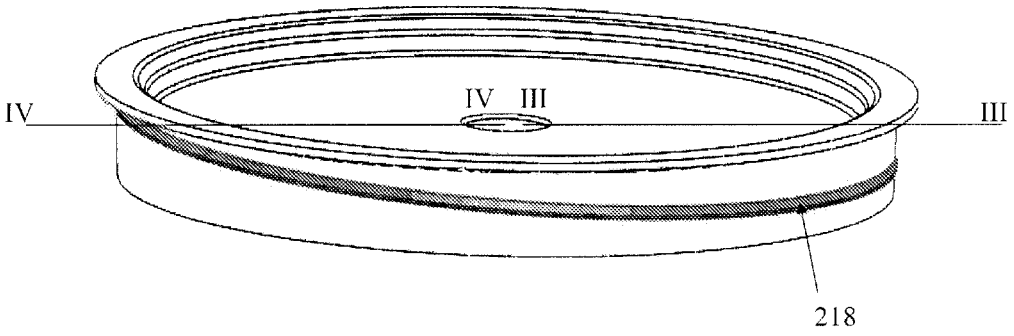
FIG. 16 illustrates a rear side perspective view of a portion of the lid of FIG. 14.
Figure 17:
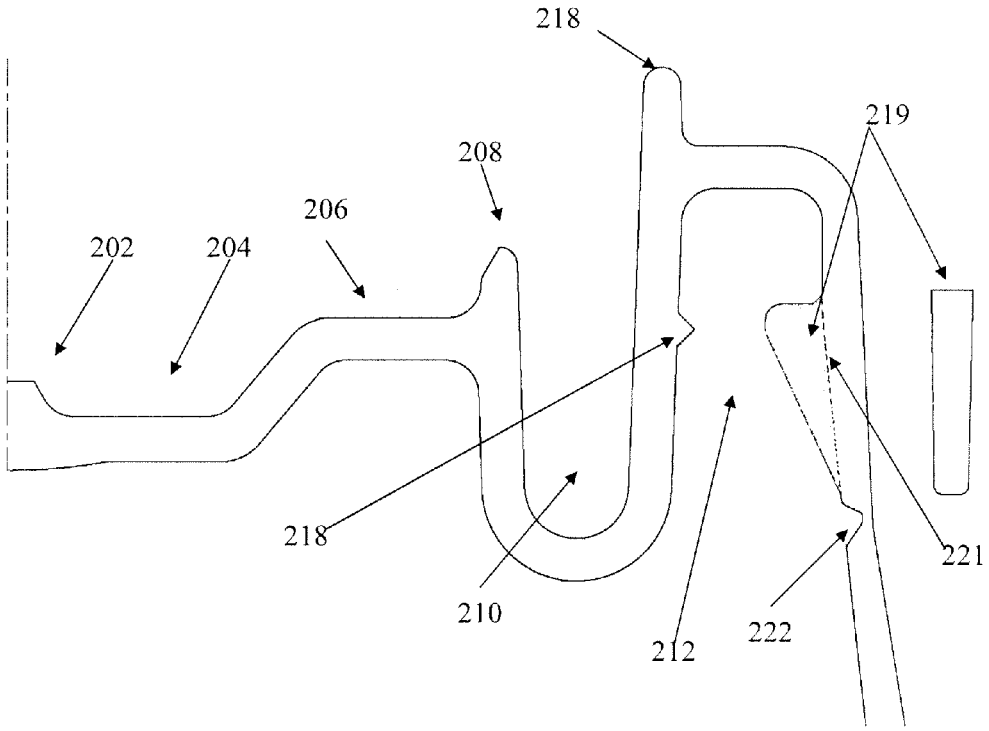
FIG. 17 illustrates a cross-section view of the lid of FIG. 14 along line III-III.
Figure 18:
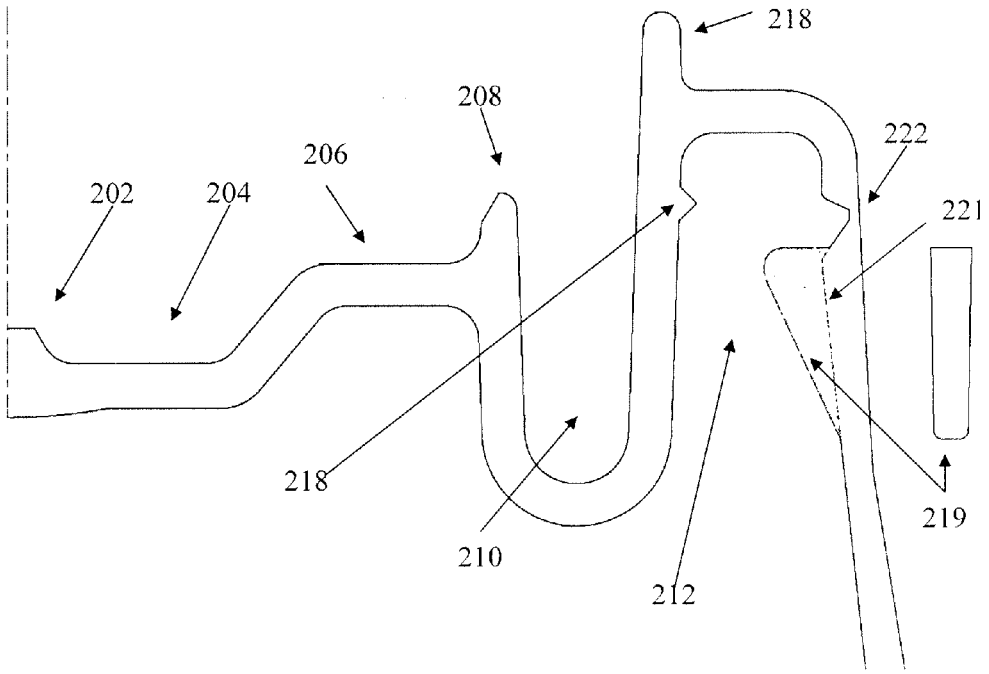
FIG. 18 illustrates a cross-section view of the lid of FIG. 14 along line IV-IV.
Figure 19:
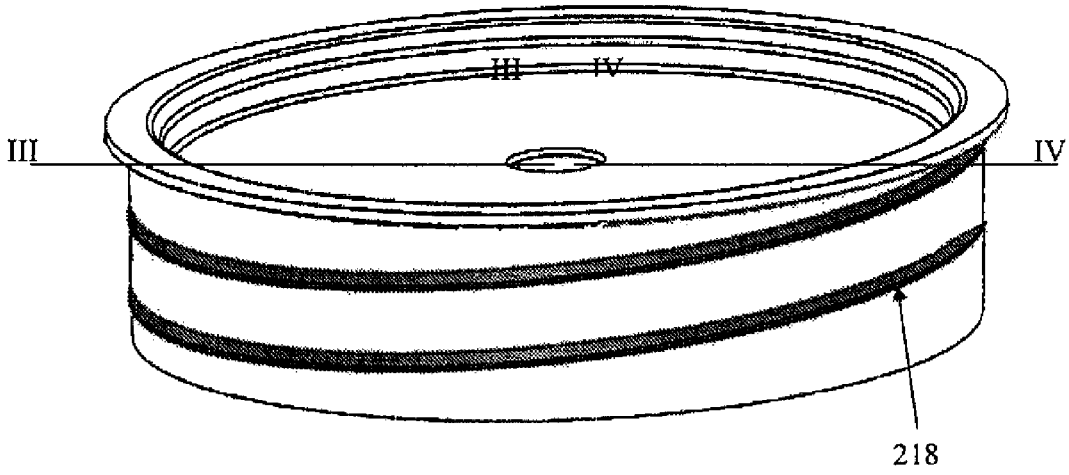
FIG. 19 illustrates a front side perspective view of a portion of a lid according to one embodiment of the present invention having multiple inner skirt protrusions.

FIG. 14 illustrates a top perspective view of a lid according to a second embodiment of the present invention. FIG. 15 illustrates a front side perspective view of a portion of the lid of FIG. 14. FIG. 16 illustrates a rear side perspective view of a portion of the lid of FIG. 14. FIG. 17 illustrates a cross-section view of the lid of FIG. 14 along line III-III. FIG. 18 illustrates a cross-section view of the lid of FIG. 14 along line IV-IV.

In another embodiment of the present invention, a lid 200 includes a diagonally oriented protrusion 218 on an inner skirt of a lid.

A problem with applying a lid to a container is that air may get trapped in the container causing the container to bulge at a sidewall or base of the container. Excess air in the container may also interact with the product in the pail and cause undesired by-products.

To address this issue, the diagonally oriented protrusion 218 may be formed on the inner skirt of the lid. A benefit of the diagonal protrusion 218 may be to allow trapped air to escape during the lidding process. The diagonally oriented protrusion 218 may extend around the entire lid to form a complete loop such that a starting and ending point of the loop are the same or to form an incomplete loop such that a starting and ending point of the loop are different. In one example, the diagonally oriented protrusion 218 may have a generally helical shape.

The upper portion of the diagonally oriented protrusion 218 is preferably closed to prevent leakage of liquid. Additionally, there may be multiple protrusions 218 in parallel. For example, the lid may include a second inner skirt protrusion. The second inner skirt protrusion may be substantially parallel to the first inner skirt protrusion. In the case of multiple protrusions 218, an upper portion of the lower protrusion may be open.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A lid for a container, comprising:

a central portion for covering an opening of the container;

a channel at a periphery of the central portion configured to form a substantially liquid-tight gasketless seal with the container, the channel including an inner skirt for contacting an inner surface of the container, an outer skirt for extending around an outside surface of the container and a wall connecting the inner skirt and the outer skirt; and an angled protrusion protruding from the inner skirt and being configured to form an interference fit with the inner surface of the container, wherein a substantial surface portion of an underside of the wall is configured to abut the container to form the substantially liquid-tight gasketless seal;

a protruding ridge comprising substantially parallel ribs protruding from the outer skirt toward the inner skirt, wherein an upper edge of the protruding ridge is discontinuous; and a second protrusion on the inner skirt.

2. The lid of claim 1, further comprising a tearline on the outer skirt for separating an upper portion of the outer skirt and a lower tearstrip portion of the outer skirt, wherein a portion of the tearline is below a portion of the protruding ridge.

3. The lid of claim 2, wherein another portion of the tearline is above another portion of the of the protruding ridge.

4. The lid of claim 1, wherein the inner skirt angled protrusion of the inner skirt extends around the central portion and forms a complete loop such that a starting and ending point of the loop are the same.

5. The lid of claim 1, wherein the inner skirt angled protrusion of the inner skirt extends around the central portion and forms an incomplete loop such that a starting and ending point of the loop are different.

6. The lid of claim 5, wherein the inner skirt angled protrusion of the inner skirt extends around the central portion is a helical shape.

7. The lid of claim 1, wherein the angled protrusion of the inner skirt includes a first surface extending upwardly and toward the central portion and a second surface below the first surface extending downwardly and toward the central portion.

8. The lid of claim 7, wherein the first and second surfaces have an angle with respect to one another of between approximately 60 degrees and 170 degrees.

9. The lid of claim 7, wherein the first and second surfaces have an angle with respect to one another of between approximately 90 degrees and 160 degrees.

10. The lid of claim 1, wherein the substantially parallel protruding ribs are separated by a predetermined distance.

11. The lid of claim 10, wherein the predetermine distance is greater than a thickness of at least one of the protruding ribs.

12. A lid for a container, comprising:

a central portion;

an u-shaped channel extending at least partially around the central portion, the u-shaped channel having first and second generally vertical sidewalls;

an outer skirt separated from the second sidewall via a wall at a periphery of the u-shaped channel;

a first angled protrusion protruding from a side of the second sidewall closest to the outer skirt and being configured to form an interference fit with an inner surface of the container;

a second angled protrusion on the side of the second sidewall that is substantially parallel to the first angled protrusion and a protruding ridge on an inner surface of the outer skirt, wherein the protruding ridge includes a plurality of ribs, wherein a substantial surface portion of an underside of the wall is configured to abut the container to form a substantially liquid-tight gasketless seal and an upper edge of the protruding ridge is discontinuous.

13. The lid of claim 12, wherein the plurality of ribs are substantially parallel to each other.

14. The lid of claim 12, wherein each rib includes a lower surface that tapers towards the inner surface of the outer skirt.

15. The lid of claim 12, wherein a thickness of an upper portion of each rib is greater than a thickness of a lower portion of each rib.

16. The lid of claim 12, wherein the ribs are separated by a predetermined distance.

17. The lid of claim 16, wherein the predetermine distance is greater than a thickness of at least one of the ribs.

18. A container and lid, wherein the container comprises:

a base;

a sidewall extending upwardly from the base to an upper rim, wherein the sidewall surrounds an inner cavity, and wherein the sidewall tapers away from the inner cavity while extending upwardly from the base;

a satellite ring extending outwardly from the container sidewall; and a bead protruding outwardly from the container sidewall;

wherein the lid comprises:

a central body portion;

a channel around a periphery of the central body portion configured to form a substantially liquid-tight gasketless seal with the upper rim of the container, the channel including an outer skirt and an inner skirt, wherein the inner skirt is configured to contact an inner surface of the container sidewall, the inner skirt including a first angled inner skirt protrusion protruding outwardly from the inner skirt and extending around the central body portion and a second inner skirt angled protrusion substantially parallel to the first angled inner skirt protrusion, wherein the first and second angled inner skirt protrusions are configured to form an interference fit with the inner surface of the sidewall, wherein the channel includes a wall connecting the inner skirt and the outer skirt;

a tearline for separating an upper portion of the outer skirt and a lower tearstrip portion, wherein a lower edge of the lower tearstrip portion is configured to lie adjacent the satellite ring of the container; and a first protruding ridge on the upper portion of the outer skirt and a second protruding ridge on the lower tearstrip portion, wherein the first and second protruding ridges are configured to lie below the container bead, wherein a substantial surface portion of an underside of the wall abuts the upper rim to form the substantially liquid-tight gasketless seal and wherein an upper edge of the first protruding ridge is discontinuous and wherein and upper edge of the second protruding ridge is discontinuous.

19. The lid of claim 18, wherein the first angled protrusion of the inner skirt includes a first surface extending upwardly and toward the central portion and a second surface below the first surface extending downwardly and toward the central portion.

20. The lid of claim 19, wherein the first and second surfaces have an angle with respect to one another of between approximately 60 degrees and 170 degrees.

21. The lid of claim 19, wherein the first and second surfaces have an angle with respect to one another of between approximately 90 degrees and 160 degrees.

22. The lid of claim 18, wherein the first protruding ridge and the second protruding ridge comprise a plurality of substantially parallel protruding ribs separated by a predetermined distance.

23. The lid of claim 22, wherein the predetermine distance is greater than a thickness of at least one of the substantially parallel protruding ribs.

24. A lid for a container, comprising:

a central portion for covering an opening of the container;

a channel at a periphery of the central portion configured to form a substantially liquid-tight gasketless seal with the container, the channel including an inner skirt for contacting an inner surface of the container, an outer skirt for extending around an outside surface of the container and a wall connecting the inner skirt and the outer skirt;

an angled protrusion protruding from the inner skirt and being configured to form an interference fit with the inner surface of the container, wherein a substantial surface portion of an underside of the wall is configured to abut the container to form the substantially liquid-tight gasketless seal; and a second inner skirt protrusion.

25. The lid of claim 24, wherein the second inner skirt protrusion is substantially parallel to the first inner skirt protrusion.

26. The lid of claim 24, wherein the inner skirt angled protrusion extends around the central portion and forms a complete loop such that a starting and ending point of the loop are the same.

27. The lid of claim 26, wherein the second inner skirt protrusion is parallel to the angled protrusion and extends around the central portion and forms a complete loop such that a starting and ending point of the loop are the same.

28. The lid of claim 26, wherein the second inner skirt protrusion is parallel to and below the angled protrusion and extends around the central portion and forms an incomplete loop such that a starting and ending point of the loop are different.

29. The lid of claim 24, wherein the inner skirt angled protrusion extends around the central portion and forms an incomplete loop such that a starting and ending point of the loop are different.

30. The lid of claim 29, wherein the second inner skirt protrusion is parallel to the angled protrusion and extends around the central portion and forms a complete loop such that a starting and ending point of the loop are the same.

31. The lid of claim 29, wherein the second inner skirt protrusion is parallel to and above the angled protrusion and extends around the central portion and forms a complete loop such that a starting and ending point of the loop are the same.

32. The lid of claim 24, wherein the inner skirt angled protrusion and the second inner skirt protrusion extends around the central portion in a helical shape.

33. The lid of claim 24, wherein the angled protrusion of the inner skirt includes a first surface extending upwardly and toward the central portion and a second surface below the first surface extending downwardly and toward the central portion.

34. The lid of claim 33, wherein the first and second surfaces have an angle with respect to one another of between approximately 60 degrees and 170 degrees.

35. The lid of claim 33, wherein the first and second surfaces have an angle with respect to one another of between approximately 90 degrees and 160 degrees.

* * * * *